United States Patent [19]

Gohausen et al.

[11] 4,445,983

[45] May 1, 1984

[54] SEALING ANODICALLY PRODUCED OXIDE LAYERS, ON ALUMINUM

[75] Inventors: Hans J. Gohausen, Langenfeld; Winfried Kirchhoff, Duesseldorf; Jurgen Lindener, Monheim; Harald Wennemann, Erkrath, all of Fed. Rep. of Germany

[73] Assignee: Henkel KGaA, Duesseldorf, Fed. Rep. of Germany

[21] Appl. No.: 527,906

[22] Filed: Aug. 30, 1983

[30] Foreign Application Priority Data

Sep. 9, 1982 [DE] Fed. Rep. of Germany ..... 3233411

[51] Int. Cl.[3] ..... C25D 11/18

[52] U.S. Cl. ..... 204/35 N; 148/6.27

[58] Field of Search ..... 204/35 N; 148/6.27

[56] References Cited

U.S. PATENT DOCUMENTS

| | | | |
|---|---|---|---|
| 3,400,023 | 9/1968 | McDonald | 148/6.27 |
| 3,813,303 | 5/1974 | Hofling et al. | 148/6.27 |
| 4,293,441 | 10/1981 | Newell et al. | 204/35 N |

*Primary Examiner*—R. L. Andrews

*Attorney, Agent, or Firm*—Ernest G. Szoke; Henry E. Millson, Jr.

[57] ABSTRACT

A process for sealing anodically produced oxide layers on aluminum and aluminum alloys by treating them with an aqueous solution at a temperature between about 90° C. and its boiling point, wherein the aqueous solution has a pH of from about 4 to about 8 and and contains from about 0.0005 to about 0.5 g/l of at least one phosphinocarboxylic acid or its water-soluble salt.

15 Claims, No Drawings

SEALING ANODICALLY PRODUCED OXIDE LAYERS, ON ALUMINUM

BACKGROUND OF THE INVENTION

This invention relates to a process for sealing anodically produced oxide layers on aluminum or aluminum alloys by treatment with aqueous solutions at elevated temperatures to prevent the formation of troublesome aluminum hydroxide layers (sealing smut) on the surfaces thereof.

Anodically produced oxide layers are frequently applied to aluminum surfaces for the purpose of corrosion prevention. These oxide layers protect the aluminum surfaces against the effects of weathering and other corroding media. The anodic oxide layers are also applied to obtain a harder surface and, hence, increased resistance to wear of the aluminum. By virtue of the natural color of the oxide layers, coupled with the fact that in some cases they are easy to color, it is possible to obtain particularly decorative effects.

There are several known processes for applying anodic oxide layers to aluminum. For example, the oxide layers may be produced using direct current in solutions of sulfuric acid (direct current/sulfuric acid process).

The layers thus applied may be subsequently colored by immersion in solutions of a suitable dye or by an alternating-current treatment in an electrolyte solution containing metal salts. In many cases, however, solutions of organic acids such as, in particular, sulfophthalic acid or sulfanilic acid or a mixture of these acids with sulfuric acid are also frequently used for applying the oxide layers. These paticular processes are known as color anodizing processes.

However, the anodically applied oxide layers are not entirely satisfactory in regard to corrosion prevention because they have a porous structure. For this reason, the oxide layers have to be subsequently sealed. This sealing treatment is frequently carried out with hot or boiling water which seals the pores and hence considerably increases protection against corrosion.

However, in the sealing of anodically applied oxide layers, not only are the pores sealed, but a more or less thick, velvet-like coating known as sealing smut is also formed over the entire surface. This sealing smut consists of hydrated aluminum oxide and is not slip-resistant so that it spoils the decorative effect of the layer. In addition, it reduces bond strength when aluminum components are bonded and, through the enlarged effective surface, promotes subsequent soiling and corrosion. For these reasons, it has hitherto been necessary to remove the smut mechanically by hand or by chemical methods.

It is already known that sealed surfaces covered by sealing smut can be freed from the smut by treatment with a mineral acid. However, this process involves another treatment step and, in addition, requires very careful treatment with the mineral acid to prevent damage to the oxide layer.

It is also known that sealing smut can be prevented by carrying out sealing with solutions containing nickel acetate and lignin sulfonate. The disadvantage of this process lies inter alia in the yellowing of the oxide layers obtained under the effect of light. Finally, processes are also known in which, to prevent sealing smut, sealing is carried out in hot water in the presence of certain polyacrylates (German Patent No. 1,938,039) or certain dextrins (German Patent No. 1,944,452). These processes have proved to be very effective. In some cases, however, more or less visible polymer films can be formed on the surface, particularly with increasing molecular weight of the active substances used. These polymer films are undesirable. It has also been proposed to use hydroxy carboxylic acids, such as citric acid (German Patent No. 2,162,674), and also various phosphonic acids (German Patent No. 2,211,553) in small quantities as sealing smut inhibitors. Where these substances are used, however, it has been found that difficulties can arise through overdosage of the active substance, particularly in large, poorly circulated baths. This is because it is not always easy to maintain a concentration range in which sealing smut is safely prevented without adversely affecting the oxide layers. Although it was also found possible to reduce the danger of overdosage through the already known use of certain cycloaliphatic or aromatic polycarboxylic acids (German Patent Application No. 26 50 989), unintentional deviations from the optimal concentration range were still occasionally observed in practice.

DESCRIPTION OF THE INVENTION

Accordingly, the object of the present invention is to further improve existing processes and to make them even more reliable, i.e. to develop an improved process for sealing anodic oxide layers on aluminum or aluminum alloys.

The present invention relates to a process for sealing anodically produced oxide layers on aluminum or aluminum alloys by treatment with aqueous solutions having a pH-value of from about 4 to about 8 at temperatures between about 90° C. and the boiling temperature thereof, wherein the aqueous solutions contain from about 0.0005 to about 0.5 g/l of at least one phosphinocarboxylic acid, or a water-soluble salt thereof, of the formula:

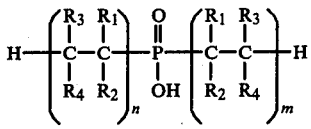

(I)

in which n and m can be the same or different and are integers of from 0 to 8, provided that $n+m=1$ to 8; $R_1$ is hydrogen or one of the groups $—CH_3$, $—C_2H_5$, $—C_3H_7$, $—C_4H_9$,

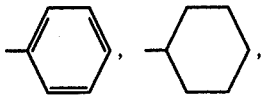

—COOH, $—CH_2—COOH$, $—CH_2—CH_2—COOH$, or —CH(COOH) $—CH_2—COOH$; and $R_2$, $R_3$ and $R_4$ can be the same or different and are each hydrogen or one of the groups $—CH_3$, $—C_2H_5$, —COOH, $—CH_2—COOH$, or $—CH_2—CH_2—COOH$; and wherein at least one of the groups $R_1$ to $R_4$ is a —COOH group or is a group that contains a —COOH group.

The phosphinocarboxylic acids of Formula I that are used in aqueous solution in the present process can be obtained by the reaction of hypophosphorous acid with unsaturated monofunctional or polyfunctional carboxylic acids of the following general formula

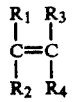

(II)

in which $R_1$, $R_2$, $R_3$ and $R_4$ have the meanings given above for the phosphinocarboxylic acids of Formula I, in a molar ratio of phosphorous acid to carboxylic acid of Formula II of from about 1:1 to about 1:8.

In the above reaction either or both of the hypophosphorous acid or the compound of Formula II can also be used in the form of a water soluble salt. If it is desired to use the phosphinocarboxylic acid of Formula I resulting from this reaction either partially or completely in the form of a water soluble salt in the process of the invention, one or both of the above reactants can be used in the form of a water soluble salt or the free acid groups in the phosphinocarboxylic acid of Formula I can be fully or partially neutralized with an appropriate base. Examples of suitable cations for salt formation are given below.

Methods for the preparation of the phosphinocarboxylic acids of Formula I are known; see for example Houben-Weyl "Methoden der Organischen Chemie", 4th Edition, Vol. XII/1, Stuttgart 1963, pages 228 to 229.

Examples of carboxylic acids of Formula II that can be used to react with hyphophosphorous acid to produce the phosphinocarboxylic acids of Formula I include acrylic acid, methacrylic acid, ethyl acrylic acid, crotonic acid, maleic acid, glutaconic acid, citraconic acid, itaconic acid, 2-butene-2-carboxylic acid, dimethyl maleic acid, 2-methylene glutaric acid, butene polycarboxylic acids, ethylene tetracarboxylic acid, pentene polycarboxylic acids and cinnamic acid.

Reaction products of hypophosphorous acid with higher unsaturated carboxylic acids can also be used in the sealing process of the invention. With increasing molecular weight, however, their use becomes increasingly more difficult with respect to optimal bath control.

As stated above, in addition to the phosphinocarboxylic acids of Formula I, it is also possible to use their water-soluble salts in the process of the invention, wherein all or some of the acid protons have been replaced; for example, by alkali, ammonium, alkaline earth, alkyl ammonium or alkanol ammonium ions. When a water-soluble salt of a phosphinocarboxylic acid of Formula I is used herein, it is present in the aqueous solutions in a quantity which is equivalent to from about 0.0005 to about 0.5 g/l of the free phosphinocarboxylic acid.

In one preferred embodiment of the process, sealing is carried out in solutions containing a reaction product formed through the addition of 2 to 8 molecules of acrylic acid onto the two P-H-functions of the hypophosphorous acid, or water-soluble salts thereof, in which the reaction product is present in a quantity of from abut 0.0005 to about 0.5 g/l, based on the free acid.

In another embodiment of the process, sealing is carried out in an aqueous solution containing the reaction product obtained from the reaction between 1 mole of hypophosphorous acid and from about 1 to about 2 moles of maleic acid, or a water-soluble salt of the foregoing, with the reaction product being present in the aqueous solution in the required quantity.

In a further embodiment of the process, sealing is carried out in an aqueous solution containing the reaction product obtained from the reaction between 1 mole of hypophosphorous acid and from about 1 to about 2 moles of citraconic or itaconic acid, or a water-soluble salt of the foregoing, with the reaction product being present in the aqueous solution in the required quantity.

In an equally useful embodiment of the process, sealing is carried out in an aqueous solution containing the reaction product obtained from the reaction between 1 mole of hypophosphorous acid and from about 1 to about 2 moles of 1-butene-2,3,4-tricarboxylic acid, or a water-soluble salt of the foregoing, with the reaction product being present in the aqueous solution in the required quantity.

The solutions of the phosphinocarboxylic acids of Formula I or their water-soluble salts according to the invention are adjusted as needed to a pH-value of from about 4 to about 8 and preferably from about 5 to about 6 using either ammonia or acetic acid. It is of advantage to use fully deionized or distilled water or water of condensation for preparing the solutions.

Sealing with the solutions according to the invention is carried out at temperatures between about 90° C. and the boiling temperature of the solution. In general, a temperature of from about 95° to about 100° C. is maintained. The sealing time is between about 1.5 and about 3.5 minutes/μm of layer thickness of the anodic oxide layer. In addition, additives known for this purpose, such as nickel or cobalt acetate, can also be added to the sealing solutions in small quantities of from about 0.0001 to about 0.5 g/l.

By use of the new process of the invention, it is possible to prevent the formation of sealing smut without damaging the anodic oxide layer or adversely affecting the quality of the sealing. By virtue of the special properties of the active substances used, the danger of unintentional and harmful overdosage is greatly reduced. There is no need for rinsing after sealing or for spraying to remove any residues from the surface. The appearance of the surface is not affected by the process according to the invention, i.e., the effects obtained by pretreatment and anodization remain intact.

The invention will be better understood from the following examples, which are given for illustration purposes only and not to limit the invention.

In the following examples, the aluminum alloys used are designated in accordance with DIN 1725. The quality of the oxide layers was determined by the admittance or y-value in accordance with DIN 50 949 and by the loss factor d in accordance with ISO/TC 79/SC2 (ALL-1) Dok.65 E. In addition, the quality of sealing was tested by the chromophosphoric acid test (ISO 3210).

EXAMPLE 1

After anodic oxidation by the direct current/sulfuric acid process (layer thickness 20 μm), an alkali-degreased and pickled aluminum plate (Al 99.5) was sealed in a solution which contained in deionized water 0.01 g/l of a reaction product of 2 moles of maleic acid with 1 mole of hypophosphorous acid and which had been adjusted with ammonia to pH 5.8.

The reaction product of 2 moles of maleic acid with 1 mole of hypophosphorous acid had been produced by adding 45 of sodium hypophosphite monohydrate to 100 g of maleic acid dissolved in 250 ml of water. The reaction mixture was heated to 60° C. and 8 g of ammonium persulfate dissolved in water were added dropwise in small portions over a period of 4 hours. The reaction mixture was kept at 60° C. for another 2 hours. The solution obtained was used for the tests without isolating the reaction product; the active substance content corresponded to the starting materials used.

Sealing of the anodized aluminum was carried out for 60 minutes at 98° C. Thereafter, the plates did not show any sealing smut. The layer thickness was unchanged at 20 μm. The dielectric loss factor amounted to 0.42 while the admittance had fallen from more than 400 to 12.5 μs. In the chromophosphoric acid test, a weight loss of 12.9 mg/dm$^2$ was observed.

After corresponding pH-adjustment with acetic acid, practically identical results were obtained using equivalent quantities of the sodium, potassium, ammonium, magnesium, calcium, tetramethyl ammonium and alkanolamine salts of the reaction product of 2 moles of maleic acid with 1 mole of hypophosphorous acid.

EXAMPLE 2

Alkali-degreased and pickled sections of the alloy AlMgSi 0.5 were anodically oxidized by the direct current/sulfuric acid-oxalic acid process (layer thickness 19 μm) and electrolytically colored bronze in a tin-containing coloring electrolyte. The sections were then sealed for a period corresponding to 3 mins/μm of layer thickness at 98° C. in a solution adjusted to pH 6.0 which contained in deionized water 0.001 g/l of a reaction product of hypophosphorous acid with 8 moles of acrylic acid.

The reaction product of acrylic acid with hypophosphorous acid had been obtained as follows:

A suspension of 100 g of 50% hypophosphorous acid, 40 g of acrylic acid, 4 g of benzoyl peroxide containing 25% of water and 300 ml of water was carefully heated while stirring to 95°–98° C. The exothermic reaction which began was kept going for 45 minutes without any further external heating by the addition of an additional 340 g of acrylic acid. On completion of the addition and after the exothermic reaction had abated, the mixture was stirred for 3 hours at 95° to 100° C. The viscous solution obtained, which was calculated to contain 430 g of active substance, was used in the above sealing tests.

After sealing, which was carried out as described above, the sections did not show any sealing smut or other visible surface deposits. The layer thickness remained unchanged at 19 μm. The admittance had fallen from more than 400 to 17 μs. The dielectric loss factor amounted to 0.45. A weight loss of 9.3 mg/dm$^2$ was observed in the chromophosphoric acid test.

The same results were obtained with the reaction product of acrylic acid with hypophosphorous acid in a molar ratio of 4:1 or with equivalent quantities of its sodium, potassium, ammonium, magnesium, calcium, tetramethyl ammonium or alkanolamine salt after corresponding pH-adjustment.

EXAMPLE 3

Sections of the alloy AlMgSi 0.5 which had been degreased and pickled in the usual way were anodically oxidized by the direct current/sulfuric acid process (layer thickness 18–21 μm). The sections thus oxidized were sealed for 60 minutes at 97°–100° C. and at a pH-value of 5.8 (adjusted with ammonia or acetic acid) in solutions containing the reaction products given in Table 1 below of hypophosphorous acid with itaconic acid, citraconic acid and 1-butene-2,3,4-tricarboxylic acid-produced as in Example 1-in the quantities set forth in Table 1.

Table 1 shows the smut-inhibiting effect and the influence of the substances on layer quality as expressed by results of measurement of admittance, the dielectric loss factor and the weight loss in the chromophosphoric acid test. Where the compounds according to the invention are used in appropriate concentrations, sealing smut is prevented and layer quality is not adversely affected. Table 1 includes comparison tests with cyclohexane hexacarboxylic acid and phosphonobutane-2,3,4-tricarboxylic acid which show that although the comparison substances prevent sealing smut, they cause serious layer damage in view of the higher concentrations required.

TABLE 1

| Reaction product $H_3PO_2$ with | Molar ratio | Concentration (g/l) | Admittance (μs) | Loss factor | Weight loss in the chromophosphoric acid test (mg/dm$^2$) | Smut |
|---|---|---|---|---|---|---|
| Itaconic acid | 1:1 | 0.01 | 10.5 | 0.41 | 7.9 | Prevented |
| | 1:1 | 0.04 | 10.5 | 0.42 | 9.3 | Prevented |
| | 1:2 | 0.05 | 10.8 | 0.38 | 8.0 | Prevented |
| | 1:2 | 0.15 | 10.7 | 0.42 | 10.8 | Prevented |
| | 1:4 | 0.1 | 12.1 | 0.45 | 10.1 | Prevented |
| Citraconic acid | 1:1 | 0.02 | 11.6 | 0.45 | 12.3 | Prevented |
| | 1:2 | 0.3 | 11.7 | 0.47 | 8.9 | Prevented |
| 1-Butene-2,3,4-tricarboxylic acid | 1:1 | 0.001 | 11.0 | 0.48 | 8.0 | Prevented |
| | 1:2 | 0.01 | 11.8 | 0.46 | 11.5 | Prevented |
| | 1:1 | 0.2 | 13.0 | 0.48 | 12.5 | Prevented |
| Comparison tests | | | | | | |
| Cyclohexane hexacarboxylic acid | — | 0.3 | 26.2 | 0.51 | 49 | Prevented (layer damage) |
| Phosphonobutane-2,3,4-tricarboxylic acid | — | 0.2 | 35.6 | 0.62 | 71 | Prevented (layer damage) |

What is claimed is:

1. A process for sealing an anodically produced oxide layer on aluminum or an aluminum alloy comprising treating said anodically produced oxide layer with an aqueous solution at a temperature between about 90° C. and the boiling point thereof, wherein said aqueous solution has a pH of from about 4 to about 8 and contains from about 0.0005 to about 0.5 g/l of at least one phosphinocarboxylic acid or a water-soluble salt thereof in which the phosphinocarboxylic acid has the formula:

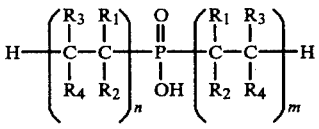

(I)

wherein n and m can be the same or different and are integers of from 0 to 8, provided that n+m=1 to 8; $R_1$ is hydrogen or one of the groups —$CH_3$, —$C_2H_5$, —$C_3H_7$, —$C_4H_9$,

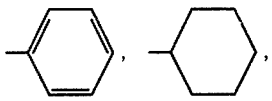

—COOH, —$CH_2$—COOH, —$CH_2$—$CH_2$—COOH, or —CH(COOH)—$CH_2$—COOH, and $R_2$, $R_3$ and $R_4$ can be the same or different and are each hydrogen or one of the groups —$CH_3$, —$C_2H_5$, —COOH, —$CH_2$—COOH, or —$CH_2$—$CH_2$—COOH; and wherein at least one of the groups $R_1$ to $R_4$ is a —COOH group or is a group that contains a —COOH group.

2. A process in accordance with claim 1 wherein the pH of the aqueous solution is from about 5 to about 6.

3. A process in accordance with claim 1 wherein the treatment temperature is between about 95° and about 100° C.

4. A process in accordance with claim 1 wherein the aqueous solution also contains from about 0.0001 to about 0.5 g/l of nickel acetate or cobalt acetate.

5. A process in accordance with claim 1 wherein the treatment time is from about 1.5 to about 3.5 minutes per μm of oxide layer thickness.

6. A process in accordance with claim 1 wherein the pH of from about 4 to about 8 is obtained by the addition of either ammonia or acetic acid in quantity sufficient to bring the pH of the aqueous solution within said pH range.

7. A process in accordance with claim 1 wherein the phosphinocarboxylic acid of Formula I is the reaction product of 1 mole of hypophosphorous acid and from about 2 to about 8 moles of acrylic acid, or a water-soluble salt of one or both of the foregoing.

8. A process in accordance with claim 1 wherein the phosphinocarboxylic acid of Formula I is the reaction product of 1 mole of hypophosphorous acid and from about 1 to about 2 moles of either maleic acid, itaconic acid, citraconic acid, 1-butene-2,3,4-tricarboxylic acid, or a water-soluble salt of any of the foregoing.

9. An aqueous solution for use in sealing anodically produced oxide layers on aluminum or aluminum alloys comprising (a) water, and (b) from about 0.0005 to about 0.5 g/l of at least one phosphinocarboxylic acid or a water-soluble salt thereof wherein said phosphinocarboxylic acid has the formula:

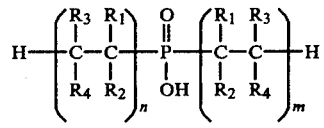

(I)

in which n and m can be the same or different and are integers of from 0 to 8, provided that n+m=1 to 8; $R_1$ is hydrogen or one of the groups —$CH_3$, —$C_2H_5$, —$C_3H_7$, —$C_4H_9$,

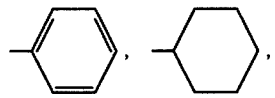

—COOH, —$CH_2$—COOH, —$CH_2$—$CH_2$—COOH, or —CH(COOH)—$CH_2$—COOH; and $R_2$, $R_3$ and $R_4$ can be the same or different and are each hydrogen or one of the groups —$CH_3$, —$C_2H_5$, —COOH, —$CH_2$—COOH, or —$CH_2$—$CH_2$—COOH; and wherein at least one of the groups $R_1$ to $R_4$ is a —COOH group or is a group that contains a —COOH group;

and wherein the aqueous solution has a pH of from about 4 to about 8.

10. An aqueous solution in accordance with claim 9 wherein the water in (a) is deionized water, distilled water, or water of condensation.

11. An aqueous solution in accordance with claim 9 wherein the pH of the aqueous solution is from about 5 to about 6.

12. An aqueous solution in accordance with claim 9 wherein the aqueous solution also contains from about 0.0001 to about 0.5 g/l of nickel acetate or cobalt acetate.

13. An aqueous solution in accordance with claim 9 wherein the pH of from about 4 to about 8 was obtained by the addition of either ammonia or acetic acid in quantity sufficient to bring the pH of the aqueous solution within said pH range.

14. An aqueous solution in accordance with claim 9 wherein the phosphinocarboxylic acid of Formula I is the reaction product of 1 mole of hypophosphorous acid and from about 2 to about 8 moles of acrylic acid, or a water-soluble salt of either or both of the foregoing.

15. An aqueous solution in accordance with claim 9 wherein the phosphinocarboxylic acid of Formula I is the reaction product of 1 mole of hypophosphorous acid and from about 1 to about 2 moles of either maleic acid, itaconic acid, citraconic acid, 1-butene-2,3,4-tricarboxylic acid, or a water-soluble salt of any of the foregoing.

* * * * *